US006043789A

United States Patent [19]

Suzuki et al.

[11] Patent Number: 6,043,789

[45] Date of Patent: Mar. 28, 2000

[54] SATELLITE BROADCAST RECEIVING CONVERTER

[75] Inventors: Shigetaka Suzuki, Fukushima-ken; Shigeru Sato, Miyagi-ken, both of Japan

[73] Assignee: Alps Electric Co., Ltd., Japan

[21] Appl. No.: 09/277,212

[22] Filed: Mar. 25, 1999

[30] Foreign Application Priority Data

Mar. 26, 1998 [JP] Japan ..... 10-079090

[51] Int. Cl.[7] ..... H01Q 13/00

[52] U.S. Cl. ..... 343/786; 343/772; 343/775; 333/21 A

[58] Field of Search ..... 343/772, 775, 343/779, 786, 783, 784, 756; 333/21 A, 26, 126, 137; H01Q 13/00

[56] References Cited

U.S. PATENT DOCUMENTS

| | | | |
|---|---|---|---|
| 4,356,493 | 10/1982 | Bogner | 343/702 |
| 4,554,553 | 11/1985 | Grim | 343/786 |
| 5,017,938 | 5/1991 | Dienes | 343/874 |
| 5,245,353 | 9/1993 | Gould | 343/786 |
| 5,331,332 | 7/1994 | West et al. | 343/786 |
| 5,384,557 | 1/1995 | Yoshida et al. | 333/21 A |
| 5,459,441 | 10/1995 | Weber et al. | 333/136 |
| 5,760,658 | 6/1998 | Tokuda et al. | 333/21 A |
| 5,781,161 | 7/1998 | Kinoshita et al. | 343/786 |
| 5,796,371 | 8/1998 | Sato et al. | 343/786 |

FOREIGN PATENT DOCUMENTS

| | | |
|---|---|---|
| 42 13 539 A1 | 10/1992 | Germany . |
| 196 29 277 A1 | 1/1997 | Germany . |
| 5-267902 | 10/1993 | Japan . |
| 5-267903 | 10/1993 | Japan . |
| 9-046102A | 2/1997 | Japan . |

*Primary Examiner*—Don Wong
*Assistant Examiner*—Tho Phan
*Attorney, Agent, or Firm*—Brinks Hofer Gilson & Lione

[57] ABSTRACT

According to the present invention, there is provided a satellite broadcast receiving converter which comprises a waveguide in which the broadcast wave travelling therein travels as a first TE11 mode linearly polarized wave and as a second TE mode linearly polarized wave intersecting at a right angle with each other, a first probe disposed at a predetermined position within this waveguide for detecting the first linearly polarized wave, a first reflecting conductor disposed approximately ¼ of the wavelength separate from the first probe in the direction in which the electric wave travels for reflecting the first linearly polarized wave, a second probe disposed in the neighborhood of the first reflecting conductor for detecting the second linearly polarized wave, and a second reflecting conductor disposed approximately ¼ of the wavelength from the second probe in the direction in which the electric wave travels for reflecting the second linearly polarized wave. On the second reflecting conductor, an electrically conductive columnar portion is provided for protrusion so that it may lie in the neighborhood of the inner peripheral surface of the waveguide on the axial line thereof.

4 Claims, 5 Drawing Sheets

SATELLITE BROADCAST RECEIVING CONVERTER

BACKGROUND OF THE INVENTION

1. Field of the Invention

The present invention relates to a satellite broadcast receiving converter having a waveguide which is loaded on an outdoor antenna apparatus for receiving two kinds of linearly polarized wave signals.

2. Description of the Related Art

A conventional satellite broadcast receiving converter is described with reference to FIGS. 6 through 9. Here, FIG. 6 is a lateral view in cross section of the conventional satellite broadcast receiving converter, FIG. 7 a frontal view of the same, FIG. 8 a rear view illustrating the internal construction of the same, and FIG. 9 an external view of the same.

In these figures, a waveguide 30 is formed into a cylindrical form both ends of which are open. A circuit board 31 formed with a microstrip line is provided at the rear end of the opening 30*a* for extension while a metallic bottomed case 32 having a jaw portion 32*a* is disposed at a position, where the end of the opening 30*a* is closed with a lid, by way of the circuit board 31. Further, within the waveguide 30, disposed approximately ¼ wavelength of the received electric wave (the frequency bandwidth ranges approximately from 10.7 GHz to 12.75 GHZ) ahead of the rear circuit board 31 is a first probe 33 for detecting a first linearly polarized wave (for example, horizontally polarized wave). This first probe 33 is of substantially L-shape, and its proximal end portion is connected to the circuit board 31 while its portion extending linearly from the proximal end portion is covered with an insulative member 34 made of, for example, Teflon to incorporate into a recessed groove 30*b* of the waveguide 30 in such a way that its tip end portion may protrude into the waveguide 30 by a predetermined size.

Of both surfaces (front and rear) intersecting at a right angle with the axial line of the waveguide 30, on the surface at the side of the first probe 33, a short-circuit pattern 35 is provided to make the first probe 33 detect the reflected first linearly polarized wave while, on the other surface, a second probe 36 is patterned to detect a second linearly polarized wave (for example, perpendicularly polarized wave) intersecting at a right angle with the first linearly polarized wave. Here, since the circuit board 31 is negligibly thin as compared with the wavelength of the received electric wave, after all, any of the short-circuit pattern 35 and the second probe 36 is positioned approximately ¼ wavelength separate from the first probe 33 in the direction in which the electric wave travels (in the direction of arrow VII). Further, in this embodiment, the internal bottom surface of the metallic case 32 is formed with a short-circuit surface 32*b* to detect the reflecting second linearly polarized wave by the second probe 36.

Incidentally, within the circuit board 31, a processing circuit is provided in which the signal detected by the first probe 33 and the second probe 36 is appropriately processed (amplified or converted in frequency), and the first probe 33 and the second probe 36 are each connected to first stage amplifying transistors 41, 42 by way of withdrawing patterns 39, 40 on the circuit board 31, as shown in Fig, 8. Further, provided on the metallic case 32 are escape recesses 32*c*, 32*d* to previously avoid contact with these withdrawing patterns 39, 40.

Further, the first stage amplifying transistor 41 is connected to a second stage amplifying transistor 45 by way of the withdrawing pattern 43 while, likewise, the first stage amplifying transistor 42 is connected to the second stage amplifying transistor 45 by way of the withdrawing pattern 44. Either one of the first stage transistors 41, 42 operates depending on which one of the two linearly polarized waves is received. That is, when the first linearly polarized wave is received, the first stage amplifying transistor 41 operates, and when the second linearly polarized wave is received, the first stage amplifying transistor 42 operates. Thus, either of the linearly polarized waves is transfered to the second stage amplifying transistor 45.

The portion of the circuit board 31 which is located within the waveguide 30 is formed into a substantially T-shaped form by providing a notch 31*b*, where the short-circuit pattern 35 and the second probe 36 are formed. That is, provision of the notch 31*b* is allowed for so that the electric wave (the second linearly polarized wave) detected by the second probe 36 is not attenuated.

On the other hand, at the portions of both front and rear surfaces of the circuit board 31 which are opposed to the periphery of the end 30*a* of the rear opening of the waveguide 30, a ground electrode 37 comprising a soldered layer is provided. These ground electrodes 37, 37 are each connected to each other by a plurality of through holes 31*a* for electrical conduction of both front and rear surfaces which are provided through the circuit board 31 while the short-circuit pattern 35 is connected to the ground electrode 37. Further, since the jaw portion 32*a* of the metallic case 32 is fixed to the periphery of the opening end 30*a* of the waveguide 30 by way of the circuit board 31 by means of a vis 38, the waveguide 30 and the metallic case are each press-fitted to the ground electrode 37 on both surfaces of the circuit board 31. Incidentally, the circuit board 31 and the metallic case 32 which are attached to the rear portion of the waveguide 30 are located within a casing 46 which houses the circuit to cover by means of a cover 47. As shown in FIG. 9, an output connector 48 is provided to protrude from this casing 46 outwardly to emit the received signal.

Incidentally, since the waveguide 30 is formed into a cylindrical form, the distribution of the electromagnetic field of the electric wave which propagates therein takes mainly the TE11 mode. However, in reality, due to the presence of the discontinuous points caused by physical size variation of the waveguide or of the circuit board 2, the TM01 mode also occurs, which allows only about 25 dB isolation between the first and second linearly polarized waves to be inadequately obtained. That is, at the first probe 33 for detecting the first linearly polarized wave, a second linearly polarized wave is detected and, at the second probe 36 for detecting the second linearly polarized wave, the first linearly polarized wave is detected.

In addition, since the transmission loss of the received electric wave which propagates through the waveguide 30 increases at the frequency (for example, 9 GHz) lower than the frequency bandwidth (10.7 GHz–12.75 GHz) of the electric wave which is entered to the waveguide 30 (the waveguide exhibits the performance of a bypass filter), the isolation is further decreased, and if the frequency becomes lower, then the amplification of the first stage amplifying transistors 41, 42 becomes higher, which causes the first probe 33, withdrawing pattern 39, first stage amplifying transistor 41, withdrawing patterns 43, 44, first stage amplifying transistor 42, withdrawing pattern 40, and the second probe 36 to form a closed loop to result in a large oscillation.

Accordingly, a satellite broadcast receiving converter according to the present invention may eliminate the unnecessary TM01 mode electromagnetic field to make the isolation between the first and second linearly polarized waves greater to thereby prevent occurrence of the oscillation.

SUMMARY OF THE INVENTION

In order to solve the foregoing problem, a satellite broadcast receiving converter according to the present invention is provided with a wave guide in which the broadcast electric wave travelling therein travels in the form of a first linearly polarized TE11 mode wave and a second linearly polarized TE mode wave intersecting at a right angle with each other, a first probe located at a predetermined position within the waveguide to detect the first linearly polarized wave, a first reflecting conductor disposed about ¼ wavelength of the broadcast wave from the first probe in the travelling direction of the electric wave, a second probe disposed in the neighborhood of the first reflecting conductor to detect the second linearly polarized wave and a second reflecting conductor disposed about ¼ wavelength of the broadcast wave from the second probe in the travelling direction of the electric wave, in which an electrically conductive columnar portion is erected thereon to position in the neighborhood of the internal peripheral surface of the waveguide in parallel to the axial line thereof.

In the satellite broadcast receiving converter according to the present invention, the foregoing waveguide has an opening end at a position approximately ¼ wavelength of the foregoing broadcast electric wave from the first probe in the direction in which the broadcast electric wave travels, a circuit board is disposed at the foregoing opening end, the foregoing reflecting conductor is provided at both front and rear surfaces of the circuit board, one reflecting conductor provided on the side of the circuit board with the first probe while the second probe is provided on the other surface, of the circuit board a bottomed metallic case is provided with lid to close the wavelength the position of the lid is approximately ¼ wavelength of the broadcast electric wave from the second probe in the direction in which the electric wave travels, the internal bottom surface of the metallic case is made into the second reflecting conductor, and the foregoing electrically conductive columnar portion is integrally formed with the metallic case on the internal bottom surface.

Further, in the satellite broadcast receiving converter according to the present invention, the height of the electrically conductive columnar portion is set to ¼ wavelength of a predetermined frequency which is lower than the lowest frequency of the broadcast electric wave.

Further, in the satellite broadcast receiving converter according to the present invention, the foregoing predetermined frequency is set 1 to 2 GHz lower than the lowest frequency of the broadcast electric wave.

DESCRIPTION OF THE PREFERRED EMBODIMENT

Figure 1:
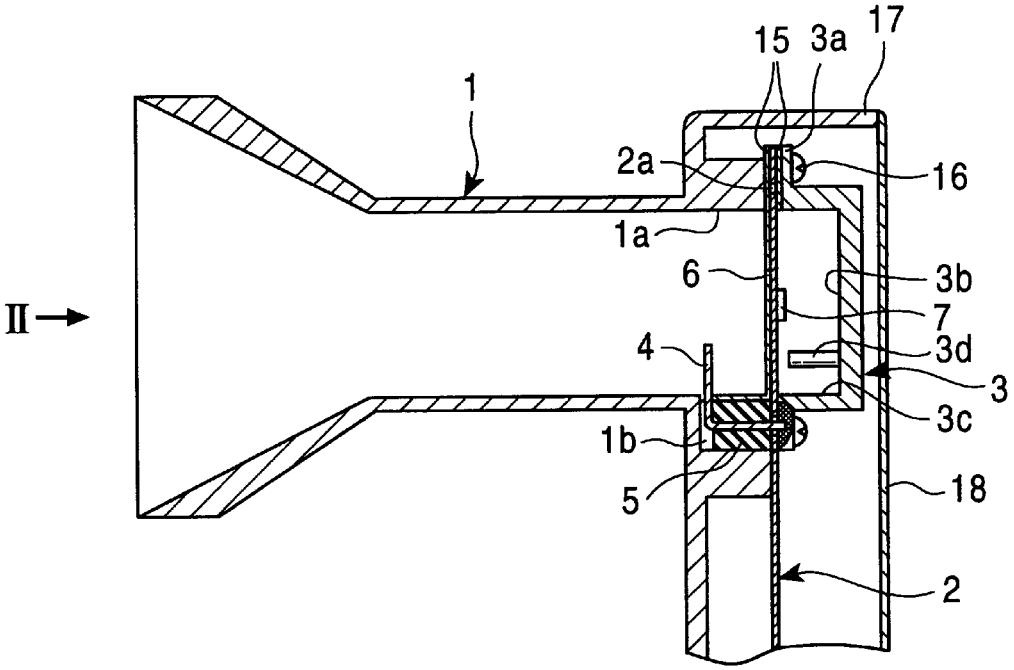
FIG. 1 is a lateral view in cross section of a satellite broadcast receiving outdoor converter according to the present invention.

A satellite broadcast receiving converter according to the present invention is hereinafter described with reference to FIGS. 1 through 5. Here, FIG. 1 is a lateral view in cross section of the same, FIG. 2 a frontal view of the same, FIG. 3 a rear view of the same illustrating the internal; construction thereof, FIG. 4 an external view, of the same FIG. 5 a characteristic view for explaining how the isolation characteristic is improved.

Referring to FIGS. 1 through 4, a waveguide 1 is formed into a cylindrical form both ends of which are open, through which mainly the TE11 mode electric wave propagates. Further, at its rear opening end 1*a*, a circuit board 2 formed with a mirostrip line is provided for extension and, further, a cylindrical metallic case 3 having a bottomed jaw portion 3*a* is disposed at a position closing the opening end 1*a* by way of the circuit board 2. Further, within the waveguide 1, a first probe 4 is disposed at a position approximately ¼ wavelength of the received electric wave (its frequency bandwidth ranges 10.7 GHz to 12.75 GHz) ahead of the circuit board 2 to detect the first linearly polarized TE11 mode wave (for example, horizontally polarized wave). This first probe 4 is of substantially L-shaped form, the proximal end portion of which is connected to the circuit board 2, and the portion linearly extending from the proximal end portion is covered with an insulative member made of, for example Teflon, to incorporate into a recess 1*b* of the waveguide 1 so that its tip protrudes into the waveguide 1 by a predetermined length.

Reflecting conductors are disposed at both the front and rear of the circuit board 2 intersecting at a right angle with the axial line of the waveguide 1, a short-circuit pattern 6 which constitutes a first reflecting conductor is provided on the surface at the side of the first probe 4 to reflect the first linearly polarized wave for detection by the first probe 4 while, on the other surface, a second probe 6 is patterned to detect the second linearly polarized TE11 wave (for example, the perpendicularly polarized wave) intersecting at a right angle with the first linearly polarized wave. Here, since the circuit board 2 is negligibly thin as compared with the wavelength of the received electric wave, the short-circuit pattern 6 and the second probe 7 are each positioned approximately ¼ wavelength from the first probe 4 in the direction in which the electric wave travels (the direction of II). Further, in this example, the internal bottom surface of the metallic case 3 is formed into a short-circuit surface 3*b*, which constitutes a second reflecting conductor, to reflect the second linearly polarized wave for detection by the second probe 7.

Here, a substantially circular columnar portion 3*d* which protrudes in parallel to the axial line of the waveguide 1 is provided from the short-circuit surface, which constitutes the internal bottom surface of the metallic case 3, in proximity with the internal wall 3*c*. This columnar portion 3*d* is integrally formed with the metallic case 3 by diecasting process and its height is set to ¼ wavelength of the predetermined frequency (for example, 9 GHz) which is lower than the lowest frequency (10.7 GHz) of the frequency bandwidth of the received signal which is enters to the waveguide 1.

Figure 3:
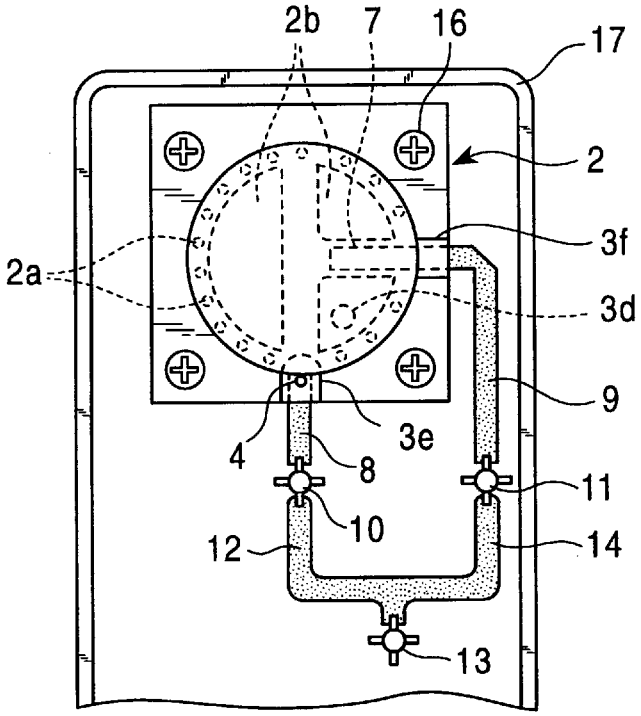
FIG. 3 is a rear view of the satellite broadcast receiving outdoor converter according to the present invention illustrating the internal construction thereof.

Incidentally, the circuit board 2 comprises a processing circuit for processing (amplifying or converting the frequency of) the signal detected by means of the first probe 4 and the second probe 7, which are each connected to first stage amplifying transistors 10, 11 by way of withdrawing patterns 8, 9 on the circuit board 2, as shown in FIG. 3. Further, escape recesses 3*e*, 3*f* are provided on the metallic case 3 to avoid contact with these withdrawing patterns 8, 9.

Further, the first stage amplifying transistor 10 is connected to the second stage amplifying transistor 13 by way of the withdrawing pattern 12 while, at the same time, the first stage amplifying transistor 11 is connected to the second stage amplifying transistor 13 by way of the withdrawing pattern 14. One of the first stage amplifying transistors 10, 11 operates depending on which one of the linearly polarized waves is received. That is, when the first linearly polarized wave is received, the first stage amplifying transistor 10 operates, and when the second linearly polarized wave is received, the first stage amplifying transistor 11 operates. Each one of the linearly polarized wave signals is transmitted to the second stage amplifying transistor 13.

Figure 2:
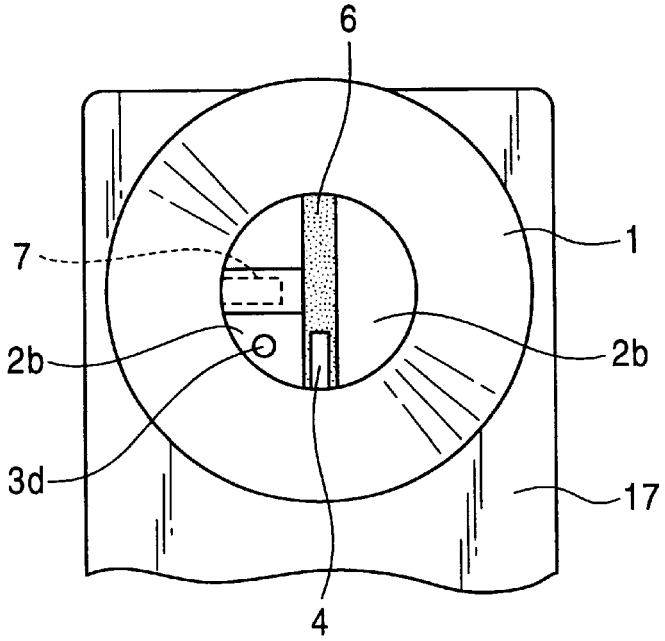
FIG. 2 is a frontal view of the satellite broadcast receiving outdoor converter according to the present invention.

The portion of the circuit board 2 which is located within the waveguide 1 is formed into a substantially T-shaped form by provision of a notch 2*b*, as shown in FIGS. 2, 3, and a short-circuit pattern 6 and a second probe 7 are formed at this substantially T-shaped portion. That is, provision of the notch 2*b* is allowed for so that the electric wave detected by the second probe 6 (the second linearly polarized wave) does not become attenuated.

Figure 4:
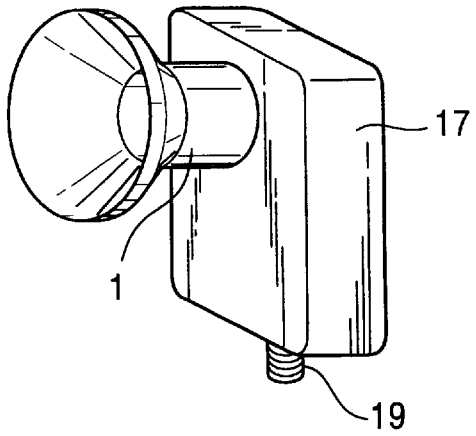
FIG. 4 is an external view of the satellite broadcast outdoor converter according to the present invention.
Figure 5:
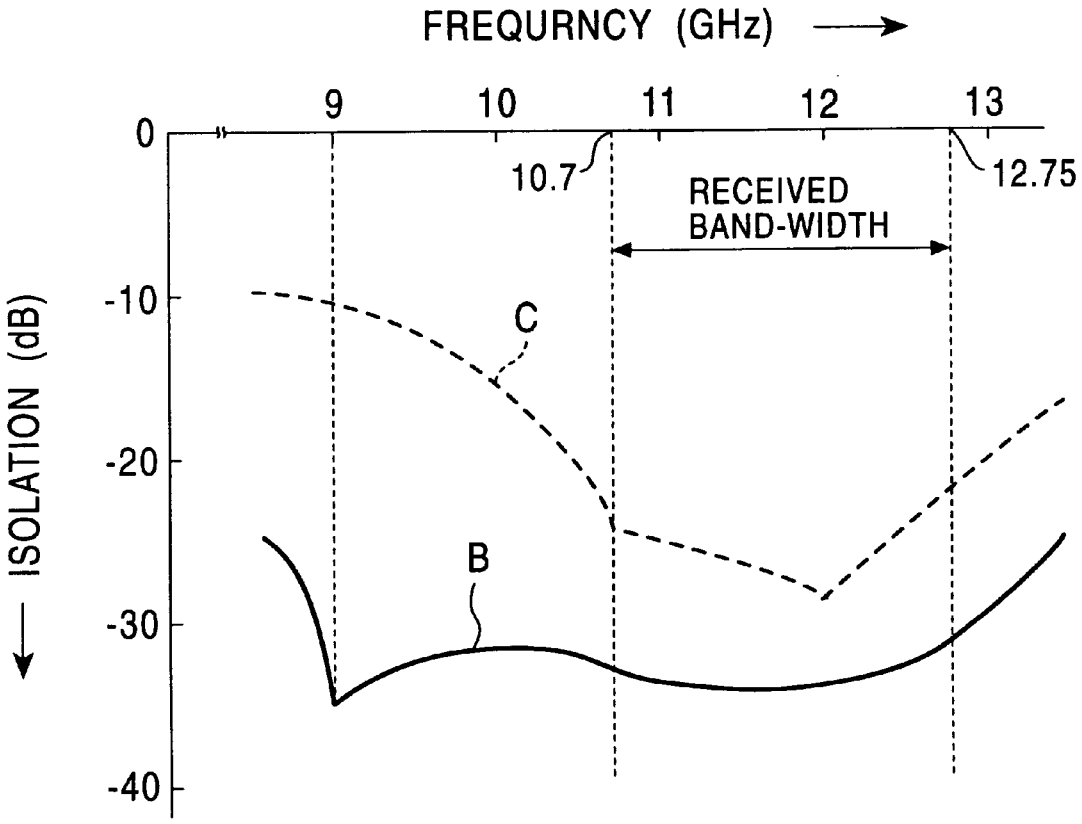
FIG. 5 is a characteristic view for explaining how the isolation characteristic of the satellite broadcast receiving outdoor converter according to the present invention is improved.
Figure 6:
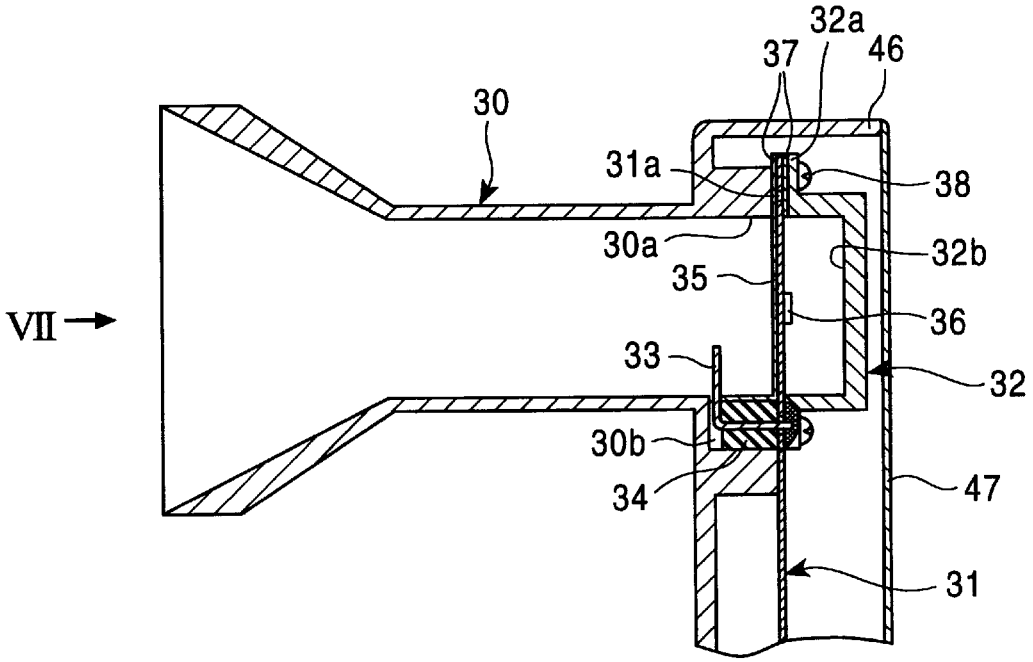
FIG. 6 PRIOR ART
FIG. 6 is a lateral view in cross section of a conventional satellite broadcast receiving outdoor converter.
Figure 7:
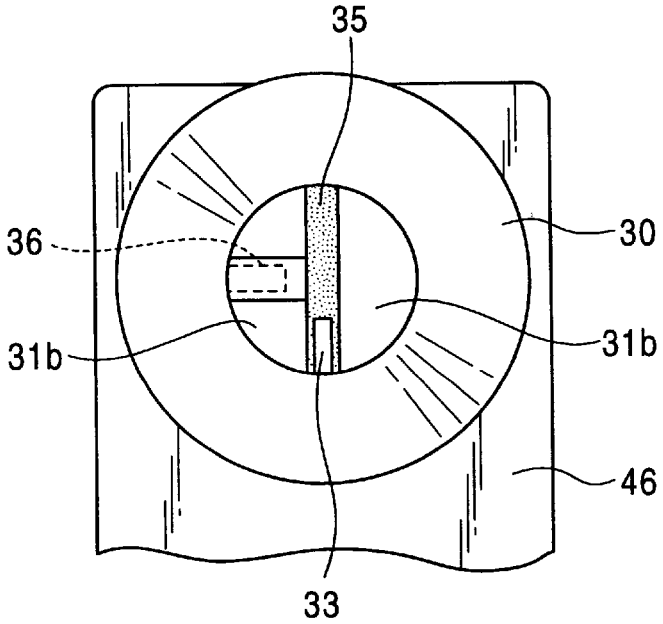
FIG. 7 PRIOR ART
FIG. 7 is a frontal view of the conventional satellite broadcast receiving outdoor converter.
Figure 8:
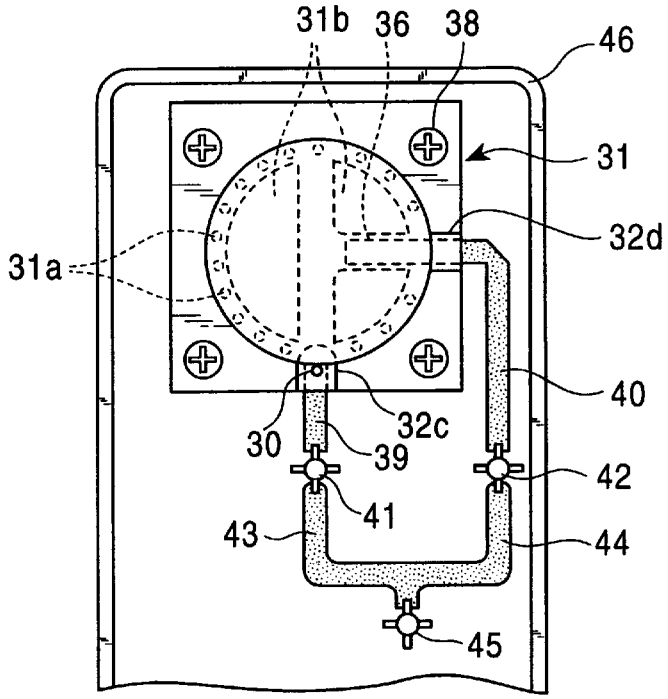
FIG. 8 PRIOR ART
FIG. 8 is a rear view of the conventional satellite broadcast receiving converter illustrating the internal construction thereof.
Figure 9:
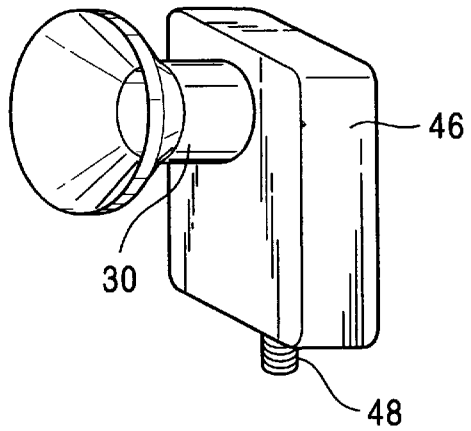
FIG. 9 PRIOR ART
FIG. 9 is an external view of the conventional satellite broadcast receiving outdoor converter.

On the other hand, provided at the portions of both front and rear surfaces of the circuit board 2 which are opposed to the peripheral edge of the rear opening end 1*a* of the waveguide 1 is a ground electrode 15 comprising a soldered layer, which are connected to each other by way of a multiplicity of through holes 2*a* for electrical conduction of the front and rear surfaces which are provided on the circuit board along the peripheral edge portion of the opening end la while the short-circuit pattern 6 is connected to the ground electrode 15. Further, since the jaw portion 3*a* of the metallic case 3 is fixed to the peripheral edge portion of the opening end la of the waveguide 1 by way of the circuit board 2 by means of a vis 16, the waveguide 1 and the metallic case 3 are each press-fitted with the ground electrode 15 on both surfaces of the circuit board 2. Incidentally, the circuit board 2 and the metallic board 3 attached to the rear portion of the waveguide 1 are located within the casing 17, which houses the circuit, to be covered with a cover 18. As shown in FIG. 4, an output connector 19 is provided to protrude from within this casing 17 outwardly to emit the received signal.

As described above, in the present invention, since the columnar portion 3*d* is made to protrude from the short-circuit surface 3*b* of the metallic case 3 and the protruding position lies in proximity with the internal wall 3*c* offset from the center of the short-circuit surface 3*b*, the TE01 mode electric wave whose electric field is focused on the internal wall 3*c*, rotated in the circumferential direction, is attenuated. Since the height of the columnar portion 3*d* is set to ¼ wavelength of frequency which is lower than the lowest frequency of the received frequency bandwidth, the TE01 mode electric wave at that frequency is attenuated. Therefore, this columnar portion 3*d* corresponds to a trap circuit referred to in the field of electric circuit doctrine. As a result, curve B of FIG. 5 exhibits isolations between the first linearly polarized wave and the second linearly polarized wave when the height of the columnar portion 3*d* is set to ¼ wavelength of 9 GHz, and with 9 GHz, good isolation is obtained, so that oscillation becomes difficult and feedback caused by the first probe 4, withdrawing pattern 8, first stage amplifying transistor 10, withdrawing patterns 12, 14, first stage amplifying transistor 11, withdrawing pattern 9 and the second probe 7. Further, as isolation at 9 GHz becomes greater, isolation of 30 dB over the entire received frequency bandwidth (10.7 GHz to 12.75 GHz) can be secured with the result that the isolation can be improved by over 5 dB than the conventional arrangement (curve C) in which no columnar portion 3*d* is provided.

Incidentally, if there is no likelihood of oscillation in the frequency bandwidth of the received electric wave and only the isolation is improved, then the height of the columnar portion 3*d* may be preset to ¼ of the wavelength of any appropriate frequency (for example, 11.7 GHz, which is substantially the central received frequency) within the frequency bandwidth of the received electric wave.

Further, the extraordinary oscillation easy occurs at frequencies where the isolation, described by the deteriorating characteristic of the waveguide 1 as the bypass filter, is lowered while the amplification of the first stage amplifying transistors 10, 11 is not so reduced. Those frequencies are about 1 to 2 GHz lower than the lowest frequency of the received electric wave. Therefore, if the height of the electrically conductive columnar portion 3*d* is also set to this frequency according to this frequency, then the extraordinary oscillation can effectively be prevented.

As described above, since the satellite broadcast receiving outdoor converter according to the present invention comprises a waveguide through which the broadcast electric wave travelling therein travels as the first TE11 mode linearly polarized wave and as the second TE mode linearly polarized wave each intersecting at a right angle with each other, a first probe disposed at the predetermined position within this waveguide for detecting the first linearly polarized wave, a first reflecting conductor disposed at the position approximately ¼ wavelength from the first probe in the direction in which the electric wave travels, a second probe disposed in the neighborhood of the first reflecting conductor for detecting the second linearly polarized wave and a second reflecting conductor disposed approximately ¼ wavelength from the second probe in the direction in which the electric wave travels for reflecting the second linearly polarized wave, on which the electrically conductive columnar portion is erected so that it lies in the neighborhood of the inner peripheral surface of the waveguide in parallel to the axial line thereof, the TM01 mode electric wave which exists mixed within the waveguide can be attenuated. Therefore, it becomes possible to improve the isolation between the first linearly polarized wave which is detected by the first probe and the second linearly polarized wave which is detected by the second probe.

Further, in the satellite broadcast receiving converter according to the present invention, since the height of the electrically conductive columnar portion is set to ¼ of the wavelength of the predetermined frequency which is lower than the lowest frequency of the broadcast electric wave, oscillation which tends to occur at low frequencies can be prevented to thereby also improve the isolation within the frequency bandwidth of the broadcast electric wave.

Likewise, in the satellite broadcast receiving converter according to the present invention, the waveguide has the opening end approximately ¼ of the wavelength from the first probe in the direction in which the broadcast electric wave travels, where the circuit board is disposed, the first reflecting conductor is provided on one surface of the circuit board on the same side as the first probe while, the second probe is provided on the lid of the metallic bottomed case and is positioned approximately ¼ of the wavelength of the electric wave from the second probe in the direction in which the electric wave travels, and the internal bottom surface of this metallic case is made to constitute the second reflecting conductor while, on this internal bottom surface, the electrically conductive columnar portion is integrally formed with the metallic case. As a result, it becomes possible to minimize the distance from the first probe up to the second reflecting conductor to thereby miniaturize the entire waveguide while readily eliminating the unnecessary TM01 mode electric wave.

What is claimed is:

1. A satellite broadcast receiving outdoor converter comprising:

a waveguide in which the broadcast electric wave travelling therein travels as a first TE11 mode linearly polarized wave and as a second TE mode linearly polarized wave intersecting at a right angle with each other;

a first probe for detecting said first linearly polarized wave, disposed at a predetermined position within said waveguide;

a first reflecting conductor for reflecting said first polarized wave, disposed approximately ¼ of the wavelength of said broadcast electric wave from said first probe in the direction in which the electric wave travels;

a second probe for detecting said second linearly polarized wave, disposed in the neighborhood of said first reflecting conductor; and a second reflecting conductor for reflecting said second polarized wave, disposed approximately ¼ of the wavelength of said broadcast electric wave from said second probe in the direction in which the electric wave travels;

an electrically conductive columnar portion erected on said second reflecting conductor so that said electrically conductive columnar portion lies in the neighborhood of the inner peripheral surface of said waveguide in parallel to the axial line thereof.

2. A satellite broadcast receiving outdoor converter as set forth in claim 1 wherein said waveguide has an opening end at a position approximately ¼ of the wavelength of said broadcast electric wave from said first probe in the direction in which said broadcast electric wave travels, a circuit board is disposed at said opening end, said first reflecting conductor is provided on the surface of said circuit board facing said first probe, said second probe is provided on the surface of said circuit board opposite to the surface on which said first reflecting conductor is provided, a metallic bottomed case with a lid is provided to close said opening end of said waveguide, the position of said lid approximately ¼ of the wavelength of said broadcast electric wave separate from said second probe in the direction in which the electric wave travels, and the internal bottom surface of said metallic case is made into said second reflecting conductor while said electrically conductive columnar portion is integrally formed with said metallic case on said internal bottom surface.

3. A satellite broadcast receiving outdoor converter as set forth in claim 1 wherein the height of said electrically conductive columnar portion is set to ¼ of the wavelength of a predetermined frequency which is lower than the lowest frequency of said broadcast electric wave.

4. A satellite broadcast receiving outdoor converter as set forth in claim 3 wherein said predetermined frequency is set 1 to 2 GHz lower than said lowest frequency of said broadcast electric wave.

* * * * *